US007588095B2

(12) United States Patent
Puzio et al.

(10) Patent No.: US 7,588,095 B2
(45) Date of Patent: Sep. 15, 2009

(54) OUTER BEARING RETENTION STRUCTURES FOR RATCHET HAMMER MECHANISM

(75) Inventors: Daniel Puzio, Baltimore, MD (US); Robert S. Gehret, Hampstead, MD (US); Warren A. Ceroll, Owings Mills, MD (US); Craig Alan Schell, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/399,457

(22) Filed: Apr. 7, 2006

(65) Prior Publication Data

US 2006/0231277 A1 Oct. 19, 2006

Related U.S. Application Data

(60) Provisional application No. 60/672,545, filed on Apr. 19, 2005.

(51) Int. Cl.
*E02D 7/02* (2006.01)

(52) U.S. Cl. ..... 173/91; 173/90; 173/217

(58) Field of Classification Search ..... 173/90, 173/91, 93.6, 93.7, 104, 217, 48
See application file for complete search history.

(56) References Cited

U.S. PATENT DOCUMENTS

| | | | | |
|---|---|---|---|---|
| 2,968,960 | A * | 1/1961 | Fulop | 173/48 |
| 3,430,708 | A * | 3/1969 | Miller | 73/45.5 |
| 3,730,281 | A * | 5/1973 | Wood | 173/48 |
| 3,736,992 | A * | 6/1973 | Zander et al. | 173/48 |
| 3,799,275 | A * | 3/1974 | Plattenhardt et al. | 173/48 |
| 3,834,468 | A * | 9/1974 | Hettich et al. | 173/48 |
| 4,567,950 | A * | 2/1986 | Fushiya et al. | 173/48 |
| 5,025,903 | A * | 6/1991 | Elligson | 192/83 |
| RE37,905 | E * | 11/2002 | Bourner et al. | 173/48 |
| 6,491,112 | B1 * | 12/2002 | Shin | 173/93.5 |
| 6,691,796 | B1 * | 2/2004 | Wu | 173/48 |
| 6,733,414 | B2 * | 5/2004 | Elger | 475/331 |
| 6,796,921 | B1 * | 9/2004 | Buck et al. | 475/299 |
| 2006/0186610 | A1 * | 8/2006 | Puzio | 279/62 |
| 2006/0186611 | A1 * | 8/2006 | Gehret et al. | 279/62 |
| 2006/0237205 | A1 * | 10/2006 | Sia et al. | 173/48 |

OTHER PUBLICATIONS

DeWalt Catalogue, 1997, front cover and p. 22.
"DW975B Type I" *Delta Service Net*. 2005. Accessed 2008. http://www.dewaltservicenet.com/Products/DocumentViewaspx?productid=6810&typeld=3937&documentld=389.

* cited by examiner

*Primary Examiner*—Brian D Nash
(74) *Attorney, Agent, or Firm*—Harness, Dickey & Pierce

(57) ABSTRACT

Provided are various embodiments of structures that may utilized in a power driver, particularly in a power driver having an optional reciprocating "hammer" action, that may be utilized for retaining an outer bearing during driver assembly and during subsequent operation of the power driver. In particular, the disclosed structures provide one or more surfaces, particularly inner peripheral surfaces, that limit the outward axial movement of the bearing. These structures may include combinations of surfaces defined by retaining members including, for example, one or more flanges, clips and threaded members, an input shaft, biasing mechanisms, typically a spring or other resilient structure, and chuck shield assemblies for positioning the outer bearing within the power driver.

17 Claims, 9 Drawing Sheets

OUTER BEARING RETENTION STRUCTURES FOR RATCHET HAMMER MECHANISM

PRIORITY STATEMENT

This application claims priority under 35 USC § 119 from U.S. Provisional Patent Application No. 60/672,545, which was filed on Apr. 19, 2005, the contents of which are herein incorporated by reference in its entirety.

BACKGROUND OF THE INVENTION

1. Field of the Invention

The present invention relates in general to imparting axial movement to tool chucks configured for attachment of accessories to power drivers, and more particularly to a tool chuck that can be selectively driven in a reciprocating "hammer" mode by engaging a ratcheting mechanism and structures adapted and configured for retaining associated bearings during assembly and use of the power driver tools.

2. Description of Related Art

Commonly-assigned, copending provisional Application, entitled "TOOL CHUCK WITH POWER TAKE OFF FEATURE," U.S. Prov. Pat. Appl., was filed Sep. 20, 2004 with the USPTO and has been allotted Ser. No. 60/610,973, and is hereafter referred to as "the '973 application." Commonly-assigned, copending provisional Application No. 11/400,378, entitled "TOOL CHUCK WITH POWER TAKE OFF AND DEAD SPINDLE FEATURES," was filed Apr. 19, 2005, and is hereafter referred to as the "the '1056 application." The entirety of each of the above-identified applications is hereby incorporated for all purposes by reference. Both of the referenced applications describe in more detail particular tool and tool chuck configurations that may incorporate the inventions detailed below.

In certain drilling applications, the effectiveness of the drilling can be increased by adding a "hammer" action, i.e., a reciprocating movement along the longitudinal axis of the drill bit or other tool held in the chuck jaws. Preferably, this hammer action can be selectively engaged and disengaged to expand the versatility of the tool and to reduce unnecessary and premature wear on the hammer mechanism(s). This engaging and/or disengaging of the hammer mechanism may be controlled by a turn ring (or sleeve) or lever that is rotated manually, without using a chuck key, to alter the configuration of the hammer mechanism.

Other developments include tool chucks that utilize power from the power driver to open and close the chuck jaws. To this end, the tool chuck may be provided with a sleeve that is axially moveable to a position in which the sleeve is grounded (i.e., rotationally fixed) to the housing of the power driver. Thus, when the driver is powered up, a spindle of the driver (and consequently the chuck jaws) rotates relative to the sleeve. The relative rotation between the spindle and the sleeve may tighten or loosen the chuck jaws.

Conventional keyless tool chucks have associated disadvantages. For example, they require a user to manipulate the sleeve (i.e., rotate the sleeve and/or slide the sleeve axially). Such manipulations may be difficult, especially when the user attempts to simultaneously insert an accessory into the chuck jaws. Also, a user may inadvertently release a grounded condition between the sleeve and the tool housing when the tool is powered up.

SUMMARY OF THE INVENTION

The various example embodiments of the invention described in more detail below relate to modifications and/or additions to various structures utilized in a power driver, particularly a power driver having an optional "hammer" action, for retaining an outer bearing during assembly and/or operation of the power driver. In particular, the disclosed structures provide one or more surfaces, particularly inner peripheral surfaces, that limit movement of the bearing along the input shaft (or spindle).

The above and other features of the invention including various and novel details of construction and combinations of parts will now be more particularly described with reference to the accompanying drawings. It will be understood that the details of the exemplary embodiments are shown by way of illustration only and not as limitations of the invention. The principles and features of this invention may be employed in varied and numerous embodiments without departing from the scope of the invention.

BRIEF DESCRIPTION OF THE DRAWINGS

The present invention will become more fully understood from the detailed description below and the accompanying drawings, wherein like elements are represented by like reference numerals, which are given by way of illustration only and thus are not limiting of the present invention.

Figure 1A:
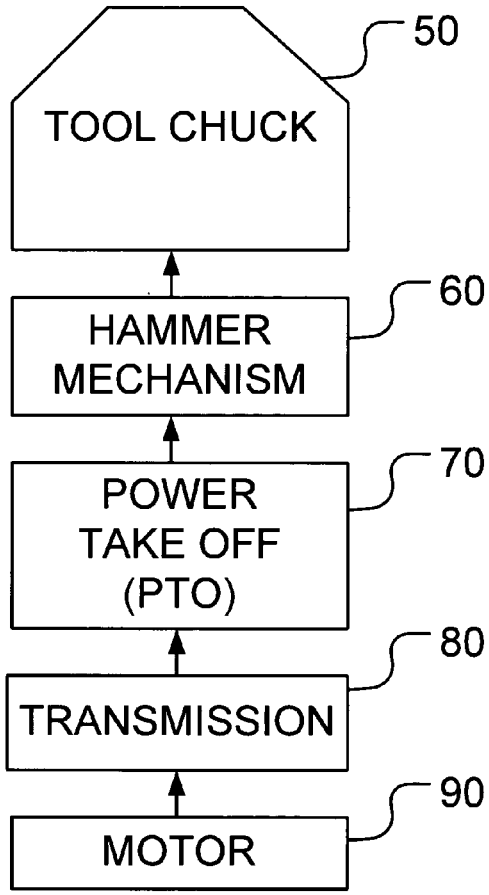
FIGS. 1A and 1B are schematic illustrations of embodiments of power tools according to example, non-limiting embodiments of the present invention.

These drawings have been provided to assist in the understanding of the example embodiments of the invention as described in more detail below and should not be construed as unduly limiting the invention. In particular, the number, relative spacing, positioning, sizing and dimensions of the various elements illustrated in the drawings are not drawn to scale and may have been exaggerated, reduced or otherwise modified for the purpose of improved clarity.

DETAILED DESCRIPTION OF EXAMPLE EMBODIMENTS

Example embodiments of the invention will now be described more fully hereinafter with reference to the accompanying drawings, in which certain example embodiments of the invention are illustrated. Those of ordinary skill in the art will also appreciate that a range of alternative configurations have been omitted simply to improve the clarity and reduce the number of drawings. Those of ordinary skill will also appreciate that certain of the various structural elements illustrated or described with respect to the various example embodiments may be selectively and independently combined to create other embodiments of tools without departing from the scope and spirit of this disclosure.

Example Embodiment Depicted in FIG. 1A

FIG. 1A illustrates, in schematic fashion, an exemplary, non-limiting embodiment of a power driver (e.g., a drill) having a tool chuck 50 configured for holding and turning an accessory (e.g., a drill bit). The tool chuck 50 may be connected to a hammer mechanism 60, a power take off (PTO) mechanism 70, a transmission 80 and finally, to an electric motor 90. The transmission 70 may use gearing to effect a series of changes in the ratio between an input rpm (from the electric motor 90) and an output rpm (delivered to the tool chuck 50) to deliver higher rotational speed or higher torque.

Figure 1B:
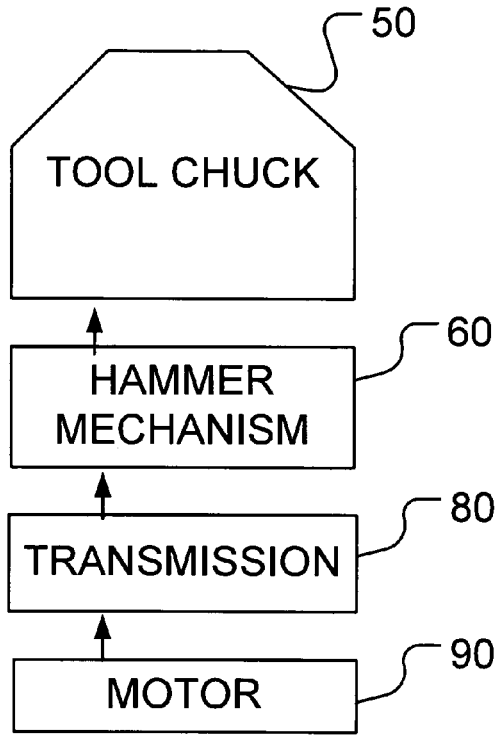

Example Embodiment Depicted in FIG. 1B

FIG. 1B illustrates, in schematic fashion, an exemplary, non-limiting embodiment of a power driver (e.g., a drill) having a tool chuck 50 configured for holding and turning an accessory (e.g., a drill bit). The tool chuck 50 may be connected to a hammer mechanism 60, a transmission 80 and finally, to an electric motor 90. The transmission 70 may use gearing to effect a series of changes in the ratio between an input rpm (from the electric motor 90) and an output rpm (delivered to the tool chuck 50) to deliver higher rotational speed or higher torque.

In both of the example embodiments illustrated in FIGS. 1A and 1B, the transmission 70 may include a plurality of planetary reduction systems, but it will be appreciated that the invention is not limited in this regard. For example, more or less than three planetary reduction systems may be implemented. Further, transmissions other than planetary reduction system transmissions (e.g., conventional parallel axis transmissions) may be utilized in the alternative or in combination as necessary to meet the power and functional design goals. Planetary reduction transmissions are well known in this art, and therefore a detailed discussion of the same is omitted.

First Example Embodiment

Figure 2:
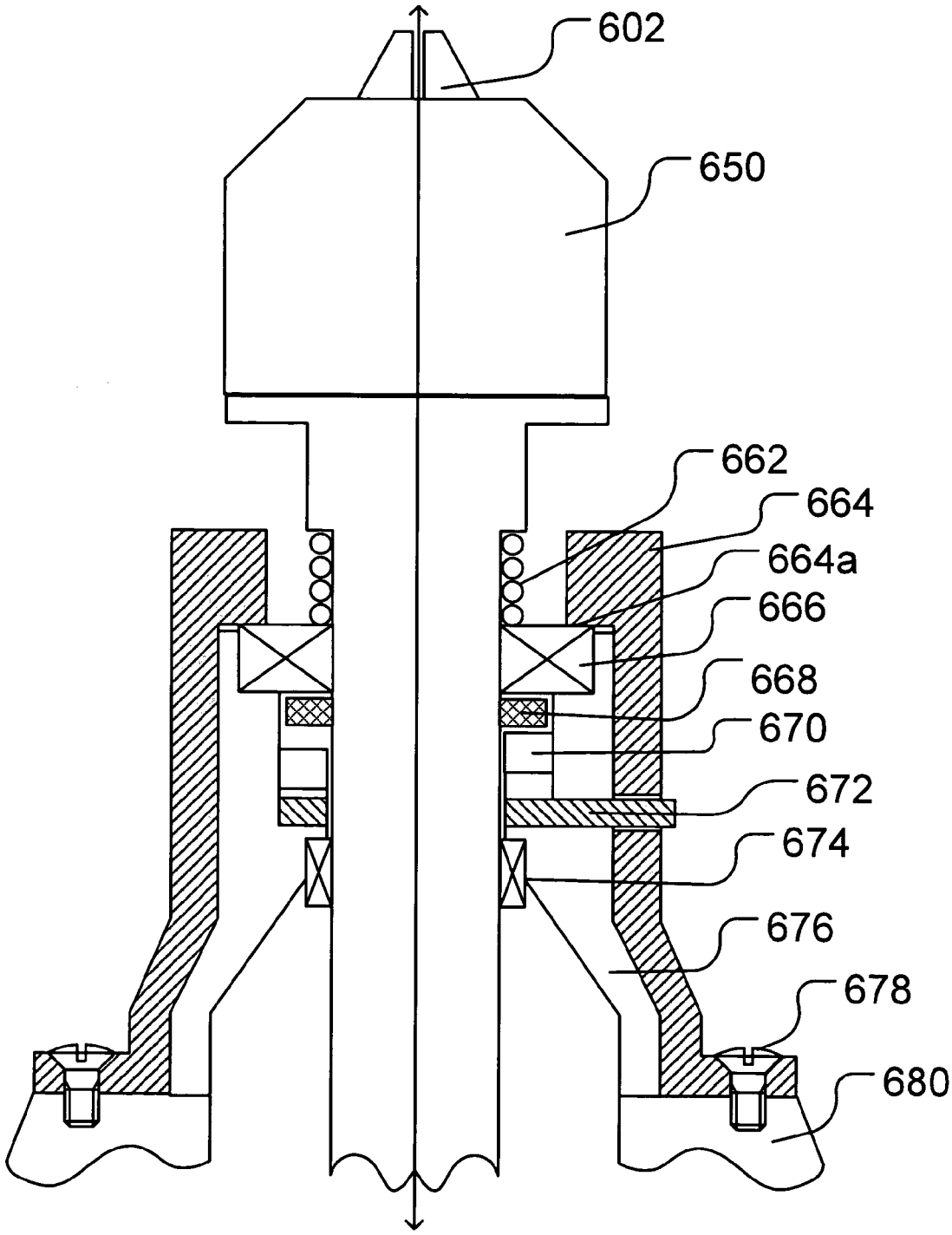
FIG. 2 is a cross-sectional view of a first example embodiment of the tool according to the invention.

FIG. 2 illustrates, in cross-section, an exemplary, non-limiting embodiment of a power driver including a chuck cone containing a plurality of movable chuck jaws 602 for selectively holding and releasing an accessory (e.g., a drill bit). The tool chuck cone may be integrally mounted on a input shaft 650 (also sometimes referred to as a spindle in tools that do not include a PTO mechanism) that may, as disclosed in the '1056 application, incorporate additional mechanisms (not shown) for actuating the chuck jaws 602. The input shaft 650 is supported, in part, by an outer bearing 666 and an inner or needle bearing 674. The input shaft 650 is also connected to a hammer mechanism that includes a rotating ratchet 668 (fixed to the rotating input shaft 650), a fixed ratchet 670 (typically fixed to the gear case housing) and a cam ring 672 that is attached to or includes a user operable lever or sleeve for selectively engaging the rotating and fixed ratchets (also referred to as front and rear anvils), typically by rotating or sliding an external extension of the cam ring.

When the hammer mechanism is engaged, opposing faces of the rotating ratchet 668 and the fixed ratchet 670 will come into contact and, as the input shaft 650 rotates, will produce a ratcheting action that will displace the shaft relative to the main tool body 680 to produce a reciprocating axial motion. This axial motion will be opposed by one or more springs 662, typically compression springs or a resilient material, that engage the input shaft 650, or a projection from the input shaft, and will tend to return the shaft to its non-displaced position. As illustrated in FIG. 2, the spring 662 can be arranged between a shoulder or stepped portion of the shaft 650 and the outer bearing 666. A portion of the input shaft 650, the hammer mechanism and the rear bearing 674 are arranged within a gear case housing 676 that can also enclose the transmission (not shown) and, if utilized, PTO mechanisms (not shown).

A bearing retainer housing 664 is configured to cooperate with the gear case housing 676 to define a recess that will retain the outer bearing 666. In particular, the bearing retainer housing 664 can be configured with a shoulder or stepped portion 664*a* that extends over a surface of the outer bearing 666 and will tend to maintain the position of the bearing during assembly and operation of the tool. The bearing retainer housing 664 can be provided with projections, slots or other openings (not shown) that will cooperate with corresponding recesses or projections from the gear case housing 676 to maintain the relative position of these two components and allow a projecting portion of the cam ring 672 to extend from the housing surface for convenient access by the operator. The bearing retainer housing 664 may also be attached to the gear case housing and/or a main tool body 680 or a main tool body 680 using one or more fasteners 678.

Second Example Embodiment

Figure 3:
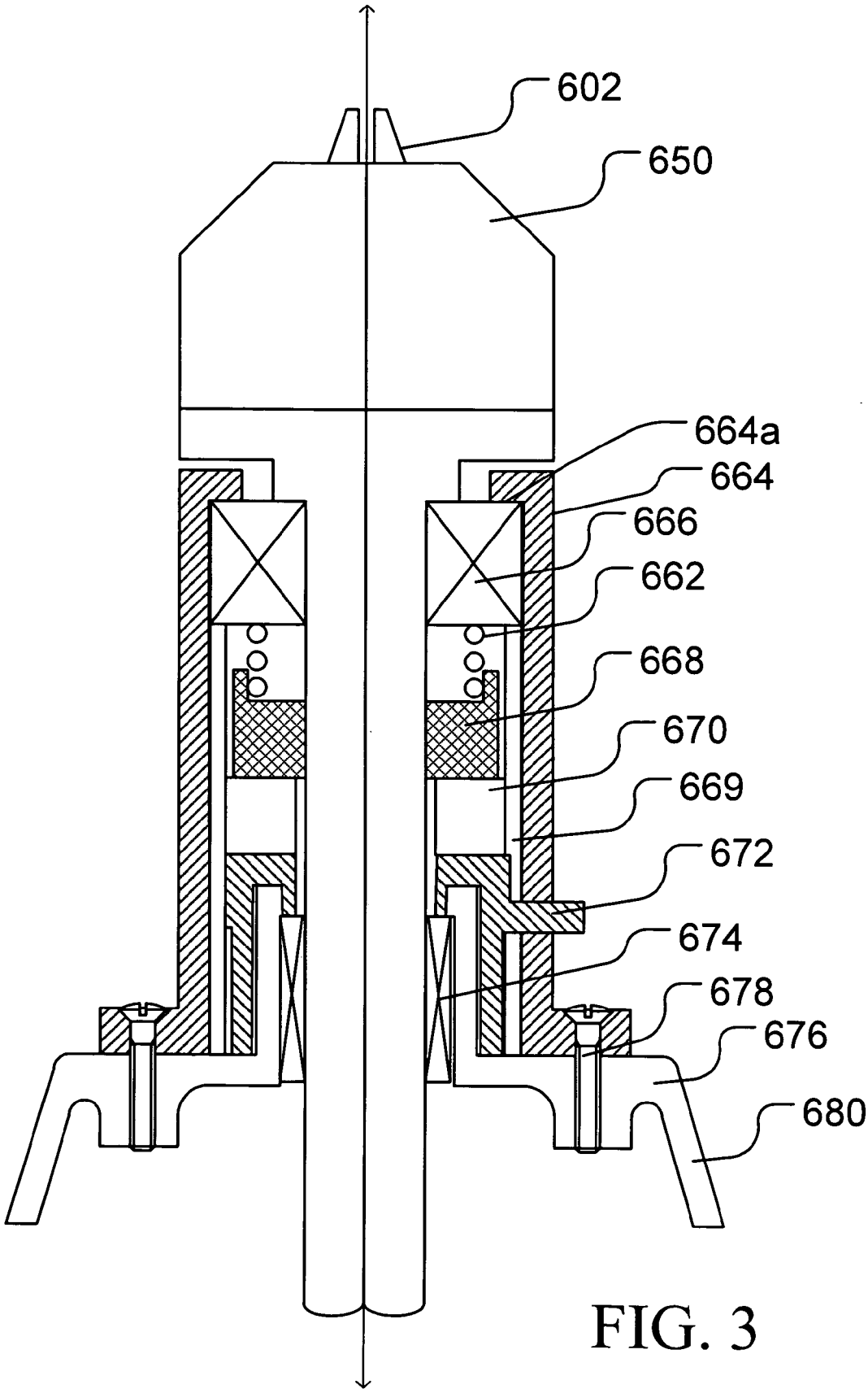
FIG. 3 is a cross-sectional view of a second example embodiment of the tool according to the invention.

FIG. 3 illustrates, in cross-section, another exemplary, non-limiting embodiment of a power driver including a chuck cone containing a plurality of movable chuck jaws 602 for selectively holding and releasing an accessory (e.g., a drill bit). The tool chuck cone is mounted on a input shaft 650 that may, as disclosed in the '1056 application, incorporate additional mechanisms (not shown) for actuating the chuck jaws 602. The input shaft 650 is supported, in part, by an outer bearing 666 and an inner or needle bearing 674.

The input shaft 650 is also connected to a hammer mechanism that includes a rotating ratchet 668, a fixed ratchet 670 and a cam ring 672 that is attached to or includes a user operable lever or sleeve for selectively engaging the ratchets, typically by rotating or sliding an external extension of the cam ring. The rotating ratchet 668, fixed ratchet 670, spring 662 and the majority of the cam ring 672 may be surrounded and contained within a backup sleeve 669 arranged between the hammer mechanism and the bearing retainer housing 664.

When the hammer mechanism is engaged, opposing faces of the rotating ratchet 668 and the fixed ratchet 670 will come into contact and, as the input shaft 650 rotates, will produce a ratcheting action that will repeatedly displace the input shaft relative to the main tool body 680 to produce a reciprocating axial motion. This axial motion will typically be opposed by one or more springs 662 that engage the input shaft 650, a projection from the input shaft, a surface of the outer bearing 666 and/or the rotating ratchet 668 and will tend to return the shaft to its non-displaced position. As illustrated in FIG. 3, the spring 662 can be arranged between the rotating ratchet 668 and the outer bearing 666. A portion of the input shaft 650, the hammer mechanism and the rear bearing 674 are arranged within a gear case housing 676 that can also enclose the transmission (not shown) and, if utilized, a PTO mechanism (not shown).

A bearing retainer housing 664 is configured to cooperate with the backup sleeve 669 to define a recess that will retain the outer bearing 666. In particular, the bearing retainer housing 664 can be configured with a shoulder or stepped portion 664*a* that extends over a portion of the surface of the outer bearing 666 and will tend to maintain the position of the bearing during assembly and operation of the tool. The bearing retainer housing can be provided with slots or other openings (not shown) that will cooperate with corresponding projections from the gear case housing 676 to maintain the relative position of these two components and allow a projecting portion of the cam ring 672 to extend from the housing surface for access by the operator. The bearing retainer housing 664 may also be attached to the gear case housing and/or a main tool body 680 using one or more fasteners 678.

Third Example Embodiment

Figure 4:
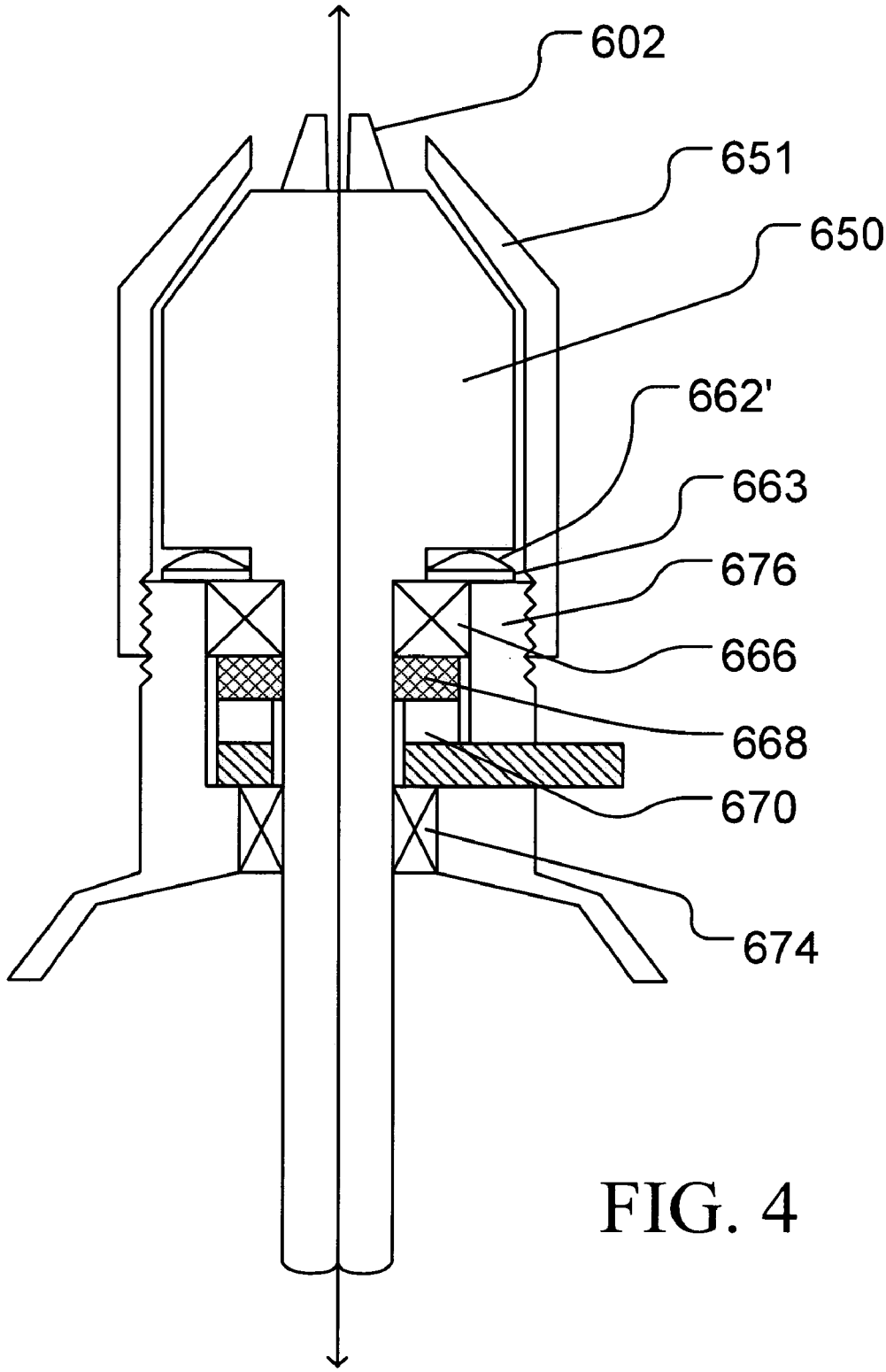
FIG. 4 is a cross-sectional view of a third example embodiment of the tool according to the invention.

FIG. 4 illustrates, in cross-section, another exemplary, non-limiting embodiment of a power driver including a chuck cone containing a plurality of movable chuck jaws 602 for selectively holding and releasing an accessory (e.g., a drill bit or a Phillips, square or Torx™ driver bit). The tool chuck cone is mounted on a input shaft 650 that may, as disclosed in the '1056 application, incorporate additional mechanisms (not shown) for actuating the chuck jaws 602. As illustrated in FIG. 4, the chuck cone can include an outer chuck cover 651 that includes a threaded lower internal surface. The threaded surface of the chuck cover 651 can engage a corresponding threaded exterior surface of the gear case housing 676. As illustrated in FIG. 4, flat spring 662', such as a Smalley wave spring or other low profile compression spring, can be provided between a lower surface of the tool chuck cone and can cooperate with a bearing retainer 663 and/or the gear case housing 676 to maintain the positioning of the outer bearing 666.

The input shaft 650 is supported, in part, by an outer bearing 666 and an inner or needle bearing 674. The input shaft 650 is also connected to a hammer mechanism that includes a rotating ratchet 668, a fixed ratchet 670 and a cam ring 672 that is attached to or includes a user operable lever or sleeve for selectively engaging the ratchets, typically by rotating or sliding an external extension of the cam ring. The rotating ratchet 668, fixed ratchet 670, and majority of the cam ring 672 may be surrounded and contained within a backup sleeve arranged between the hammer mechanism and the gear case housing 676.

When the hammer mechanism is engaged, opposing faces of the rotating ratchet 668 and the fixed ratchet 670 will come into contact and, as the input shaft 650 rotates, will produce a ratcheting action that will displace the input shaft relative to the main body 680 to produce a reciprocating axial motion. This axial motion will be opposed by one or more springs 662' that engage the input shaft 650, or a projection from the input shaft, and will tend to return the shaft to its non-displaced position. As illustrated in FIG. 4, the spring 662' can be arranged between a lower surface of the chuck cone and the outer bearing 666. A portion of the input shaft 650, the hammer mechanism and the rear bearing 674 are arranged within a gear case housing 676 that can also enclose the transmission (not shown) and, if utilized, PTO mechanisms (not shown).

Fourth Example Embodiment

Figure 5:
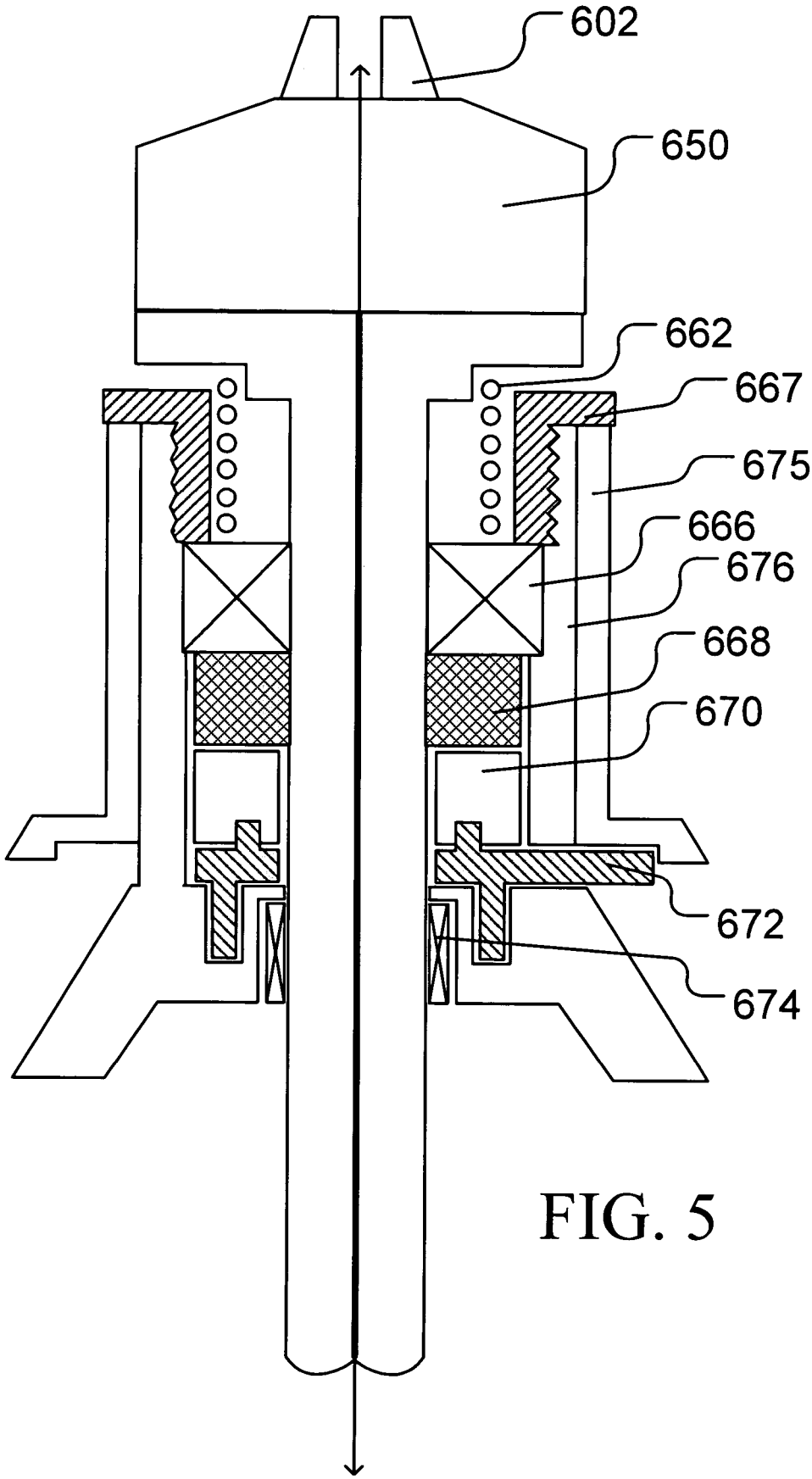
FIG. 5 is a cross-sectional view of a fourth example embodiment of the tool according to the invention.

FIG. 5 illustrates, in cross-section, another exemplary, non-limiting embodiment of a power driver including a chuck cone containing a plurality of movable chuck jaws 602 for selectively holding and releasing an accessory (e.g., a drill bit). The tool chuck cone is mounted on a input shaft 650 that may, as disclosed in the '1056 application, incorporate additional mechanisms (not shown) for actuating the chuck jaws 602.

As illustrated in FIG. 5, the gear case housing 676 can include an upper internal threaded surface. The threaded surface of the gear case housing 676 can engage a corresponding threaded exterior surface of a threaded bearing retainer 667 for retaining the outer bearing 666 within the gear case housing. As illustrated in FIG. 5, the tool may also include a sleeve retaining ring 675.

The input shaft 650 is supported, in part, by an outer bearing 666 and an inner or needle bearing 674. The input shaft 650 is also connected to a hammer mechanism that includes a rotating ratchet 668, a fixed ratchet 670 and a cam ring 672 that is attached to or includes a user operable lever or sleeve for selectively engaging the ratchets, typically by rotating or sliding an external extension of the cam ring. The rotating ratchet 668, fixed ratchet 670 and the majority of the cam ring 672 may be surrounded and contained within a space defined by the gear case housing 676.

When the hammer mechanism is engaged, opposing faces of the rotating ratchet 668 and the fixed ratchet 670 will come into contact and, as the input shaft 650 rotates, will produce a ratcheting action that will displace the input shaft relative to the main body 680 to produce a reciprocating axial motion. This axial motion will be opposed by one or more springs 662 that engage the input shaft 650, or a projection from the input shaft, and will tend to return the shaft to its non-displaced position. As illustrated in FIG. 5, the spring 662 can be arranged between a lower surface of the chuck cone and the outer bearing 666. A portion of the input shaft 650, the hammer mechanism and the rear bearing 674 are arranged within a gear case housing 676 that can also enclose the transmission (not shown) and, if utilized, PTO mechanisms (not shown).

Fifth Example Embodiment

Figure 6:
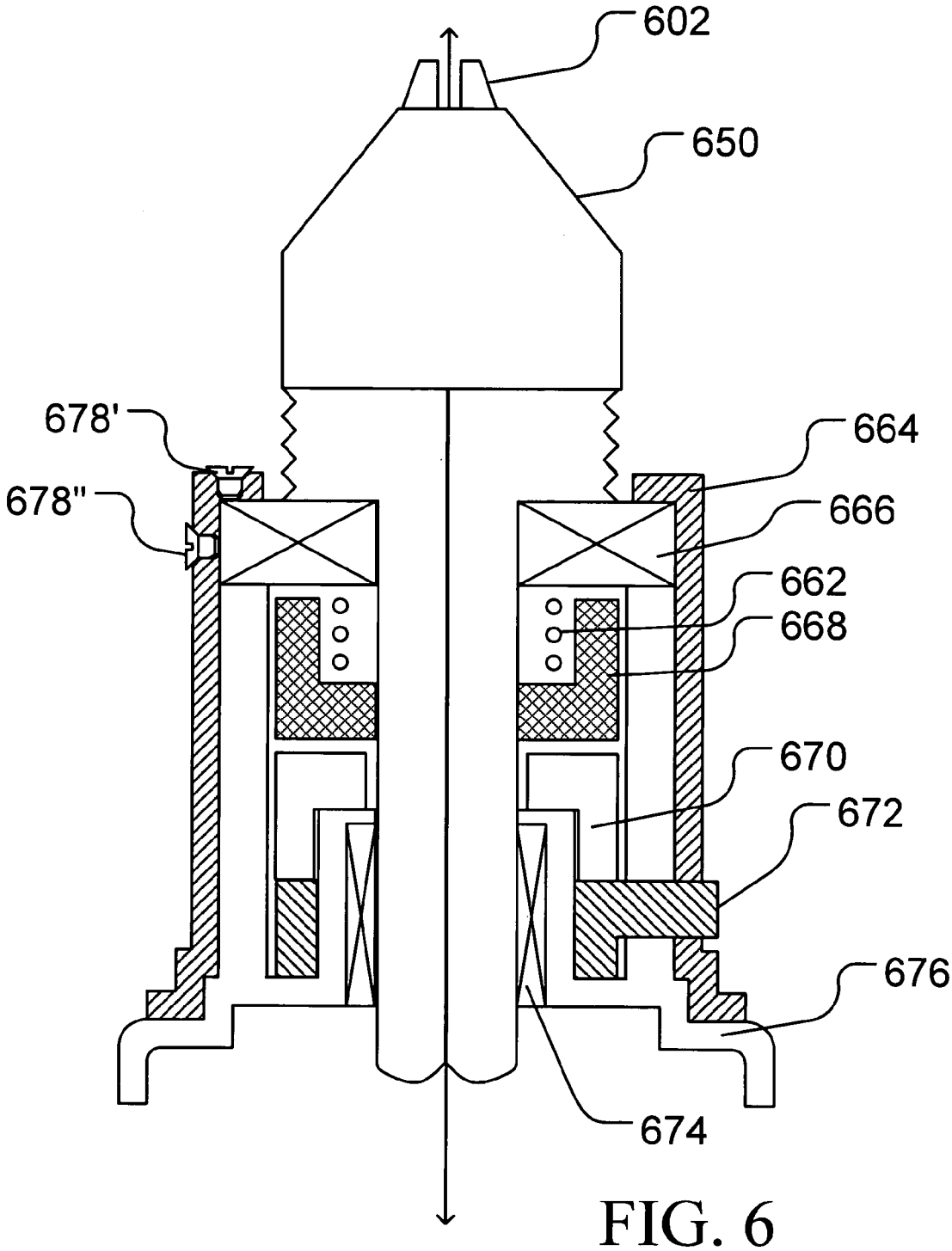
FIG. 6 is a cross-sectional view of a fifth example embodiment of the tool according to the invention.

FIG. 6 illustrates, in cross-section, another exemplary, non-limiting embodiment of a power driver including a chuck cone containing a plurality of movable chuck jaws 602 for selectively holding and releasing an accessory (e.g., a drill bit). The tool chuck cone is mounted on a input shaft 650 that may, as disclosed in the '1056 application, incorporate additional mechanisms (not shown) for actuating the chuck jaws 602.

As illustrated in FIG. 6, the chuck cone can include an outer chuck cover 651 that includes a threaded lower internal surface. The threaded surface of the chuck cover 651 can engage a corresponding threaded exterior surface of the input shaft (or spindle) 650. As illustrated in FIG. 6, spring 662 can be provided between an outer bearing 666 and the rotating ratchet 668. The input shaft 650 is supported, in part, by the outer bearing 666 and an inner or needle bearing 674.

The input shaft 650 is also connected to a hammer mechanism that includes a rotating ratchet 668, a fixed ratchet 670 and a cam ring 672 that is attached to or includes a user operable lever or sleeve for selectively engaging the ratchets, typically by rotating or sliding an external extension of the cam ring. The rotating ratchet 668, fixed ratchet 670, spring 662 and majority of the cam ring 672 may be surrounded and contained within the gear case housing 676 and the outer bearing 666. The outer bearing 666 is, in turn, located by surfaces on the gear case housing 676, a shoulder portion extending from the bearing retainer housing 664 and a lower surface of a stepped or shoulder portion of the input shaft 650.

When the hammer mechanism is engaged, opposing faces of the rotating ratchet 668 and the fixed ratchet 670 will come into contact and, as the input shaft 650 rotates, will produce a ratcheting action that will displace the input shaft relative to the main body 680 to produce a reciprocating axial motion. This axial motion will be opposed by one or more springs 662 that engage the input shaft 650, or a projection from the input shaft, and will tend to return the shaft to its non-displaced position. A portion of the input shaft 650, the hammer mechanism and the rear bearing 674 are arranged within a gear case housing 676 that can also enclose the transmission (not shown) and, if utilized, PTO mechanisms (not shown).

As also illustrated in FIG. 6, particularly on the upper left side of the illustrated embodiment, depending on the relative sizing and positioning of the various structural components, fasteners such as screws can be used to fix, on at least a temporary basis, the location of the outer bearing 666 relative to the gear case housing. The fasteners 678" can be inserted through a side surface to contact and fix the relative position of the outer bearing 666. Alternatively, or in addition to a first fastener through a side surface, when the input shaft 650 is configured to remove any peripheral portions or flanges that would tend to obscure the upper surface of the gear case housing 676, one or more fasteners 678' can be inserted through a top or upper surface of the gear case housing 676 to fix the relative position of the outer bearing 666.

Sixth Example Embodiment

Figure 7A:
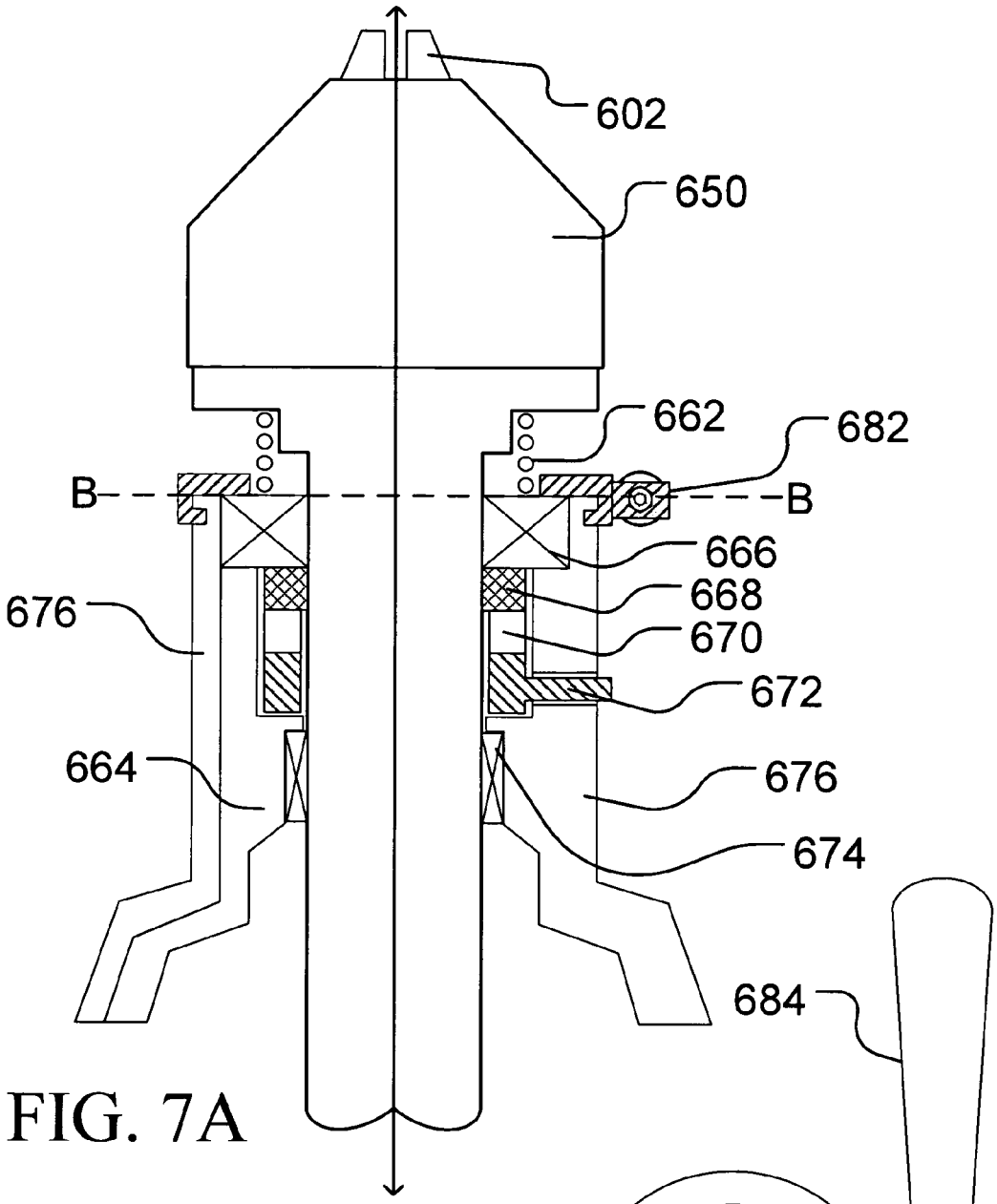
FIG. 7A is a cross-sectional view of a sixth example embodiment of the tool according to the invention and FIG. 7B is a cross-section taken along line B-B in FIG. 7A.
Figure 7B:
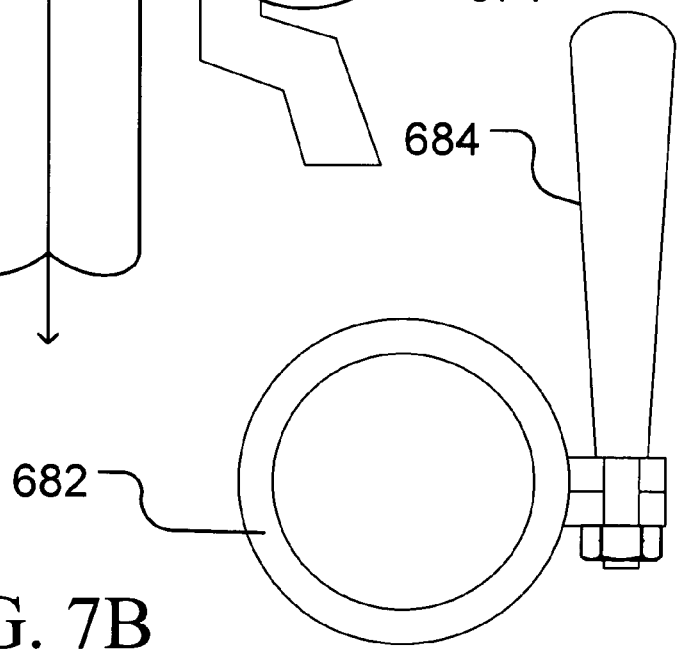

FIGS. 7A and 7B illustrate, in cross-section, another exemplary, non-limiting embodiment of a power driver including a chuck cone containing a plurality of movable chuck jaws 602 for selectively holding and releasing an accessory (e.g., a drill bit). The tool chuck cone is mounted on a input shaft 650 that may, as disclosed in the '1056 application, incorporate additional mechanisms (not shown) for actuating the chuck jaws 602.

As illustrated in FIG. 7A, the input shaft 650 is supported, in part, by the outer bearing 666 and an inner or needle bearing 674. The input shaft 650 is also connected to a hammer mechanism that includes a rotating ratchet 668, a fixed ratchet 670 and a cam ring 672 that is attached to or includes a user operable lever or sleeve for selectively engaging the ratchets, typically by rotating or sliding an external extension of the cam ring.

The rotating ratchet 668, fixed ratchet 670 and the majority of the cam ring 672 may be surrounded and contained within the gear case housing 676 and the outer bearing 666. The outer bearing 666 is, in turn, located by surfaces on the gear case housing 676 and/or an inner surface of a bearing retainer housing 664. As reflected in FIG. 7A, however, no portion of the bearing retainer housing 664 (left side of FIG. 7A) or the gear case housing (right side of FIG. 7A) extends inwardly across the outer bearing 666. The gear case housing 676 is provided with a groove or other recess into which a corresponding portion or portions of a retainer ring 682 can be fastened, at least temporarily.

As reflected in FIGS. 7A and 7B, the retaining ring 682 may have a split ring configuration, allowing the retaining ring to be positioned on and secured to a portion of the gear case housing 664 or other external surface while reducing the mechanical deformation of the retaining ring required to position it as desired on the housing. As illustrated in FIG. 7B, flanges can be provided on opposing ends of a split ring for attaching a fastener (not shown) or a handle 684 that will serve to fix the retainer ring 682 into position. As illustrated in FIG. 7A, a portion or flange may also be provided around the inner circumference of the retaining ring 682 that will extend inwardly from the retaining ring to define a lower surface that will tend to retain the outer bearing.

When the hammer mechanism is engaged, opposing faces of the rotating ratchet 668 and the fixed ratchet 670 will come into contact and, as the input shaft 650 rotates, will produce a ratcheting action that will displace the input shaft relative to the main body 680 to produce a reciprocating axial motion. This axial motion will be opposed by one or more springs 662 that engage the input shaft 650, or a projection from the input shaft, and will tend to return the shaft to its non-displaced position. A portion of the input shaft 650, the hammer mechanism and the rear bearing 674 are arranged within a gear case housing 676 that can also enclose the transmission (not shown) and, if utilized, PTO mechanisms (not shown).

Seventh Example Embodiment

Figure 8A:
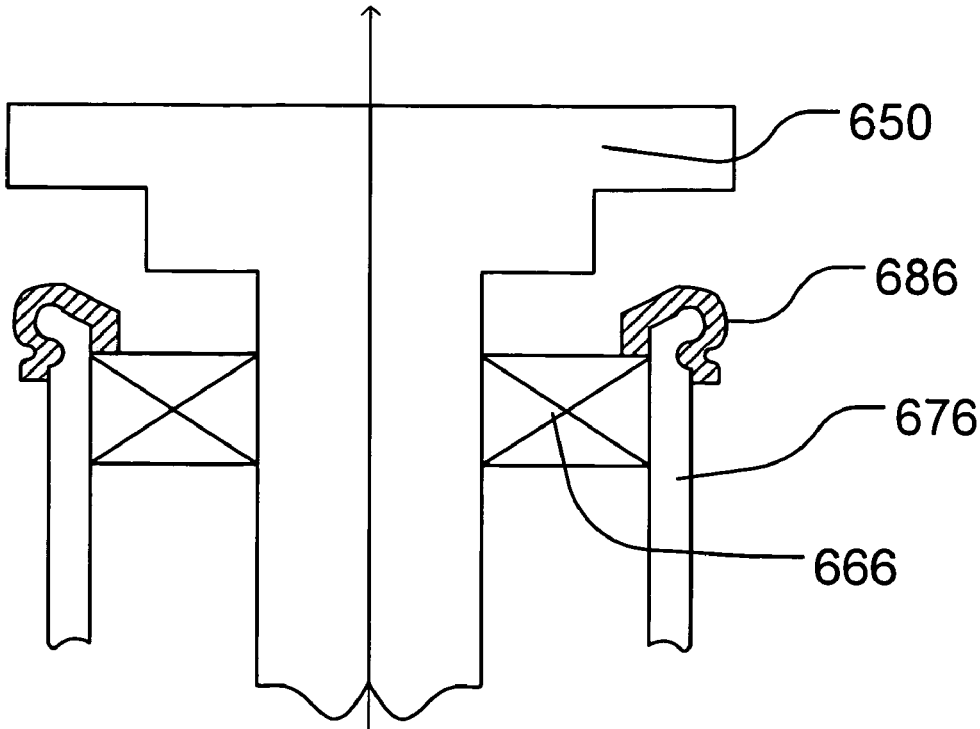
FIGS. 8A and 8B are cross-sectional views of a portion of a seventh example embodiment of a tool according to the invention.
Figure 8B:
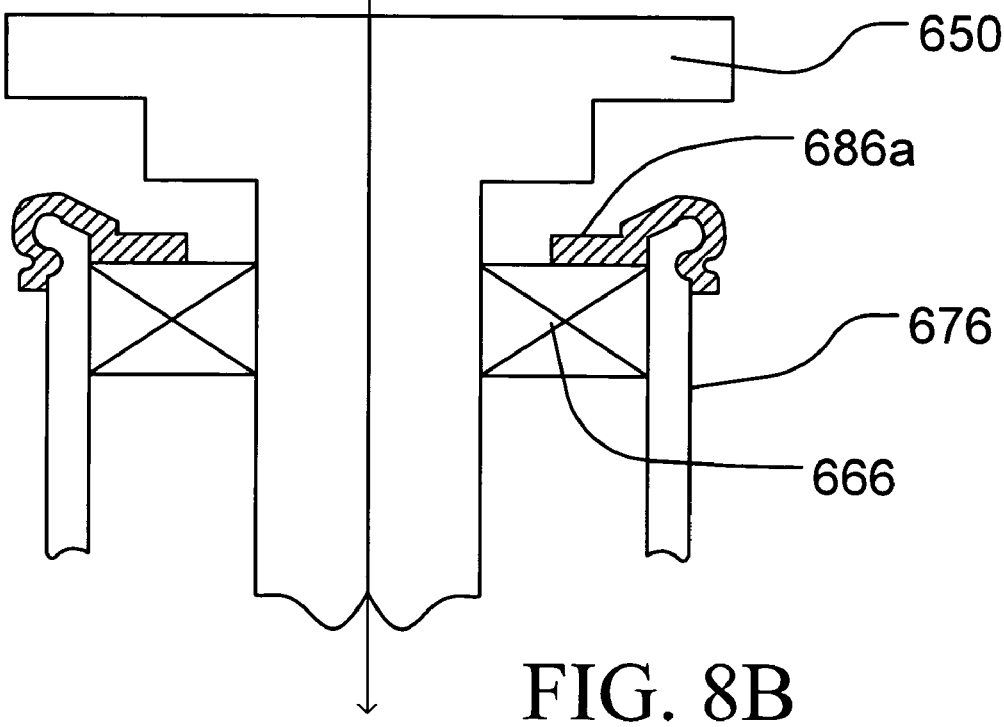

FIGS. 8A and 8B illustrate, in simplified cross-section, another exemplary, non-limiting embodiment of a power driver according to the invention that includes a input shaft 650 that is supported, in part, by the outer bearing 666 and is also connected to a hammer mechanism that includes a rotating ratchet 668 (not shown), a fixed ratchet 670 (not shown) and a cam ring 672 (not shown) that is attached to or includes a user operable lever or sleeve for selectively engaging the ratchets, typically by rotating or sliding an external extension of the cam ring.

As reflected in FIG. 8A, however, no portion of the gear case housing 676 or bearing retainer housing 664 (for the purpose of discussion only, the exterior component illustrated will be identified as a gear case housing) extends inwardly across the outer bearing 666. The gear case housing 676 is, however, provided with one or more grooves or other recess into which a corresponding portion or portions of a retainer ring or cap 686 can be fastened, at least temporarily.

As reflected in FIGS. 8A and 8B, the retaining ring 686 or cap may be configured to have one or more pliant or resilient regions that will allow it to be forced onto the gear case housing 676 until the corresponding projections "snap" or "clip" into the corresponding recesses provided on the gear case housing. Alternatively, the retaining ring 686 may be applied to the gear case housing in an original configuration (not shown) and then deformed with a tool (not shown) to conform to the groove(s) or recess(es) provided on the gear case housing to fix the retaining ring to the housing. As suggested in FIGS. 8A and 8B, the retaining ring 686, 686*a* can be provided in a range of configurations depending on the materials used and the extent to which the inner periphery extends over the outer bearing 666.

Eighth Example Embodiment

Figure 9:
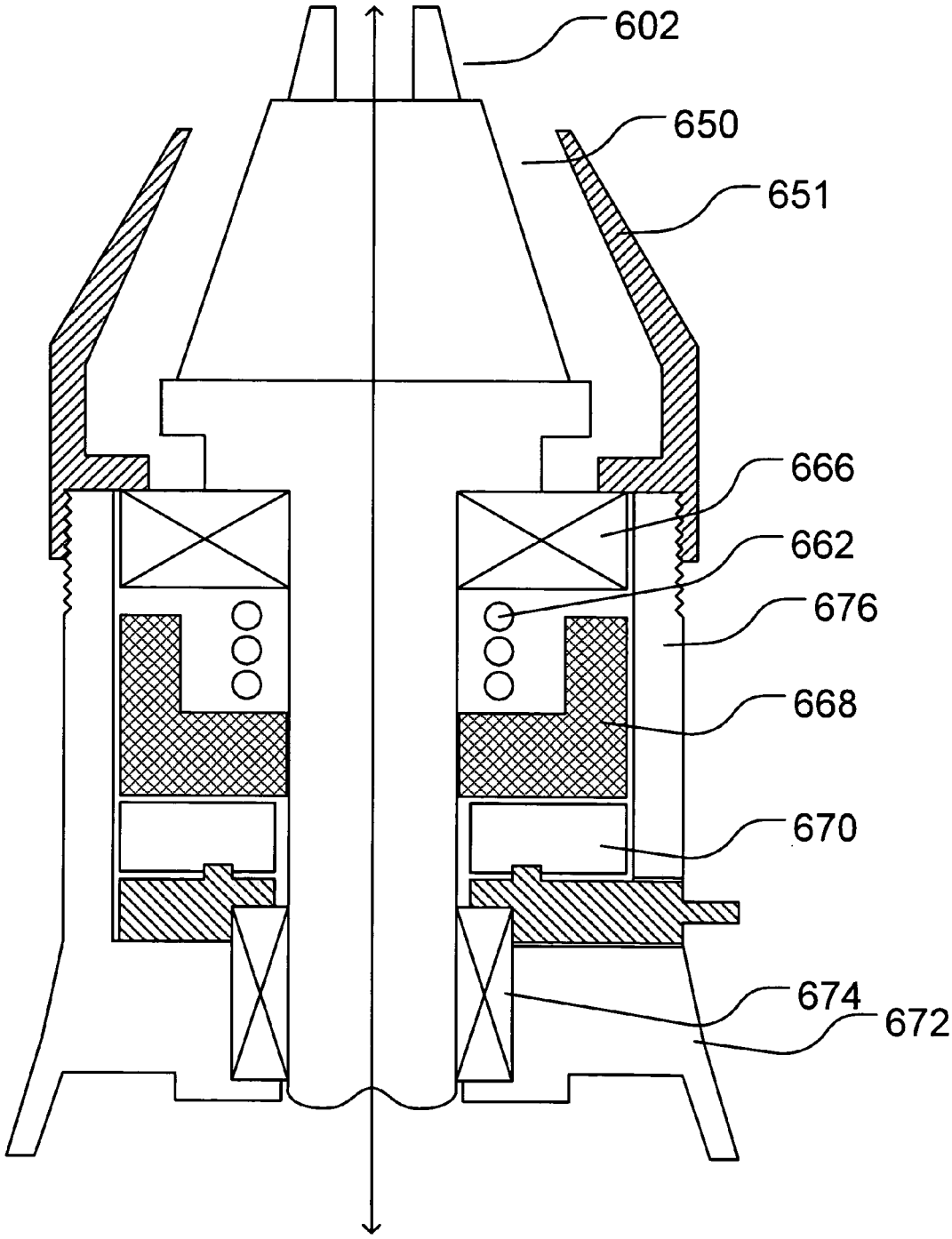
FIG. 9 is a cross-sectional view of an eighth example embodiment of a tool according to the invention.

FIG. 9 illustrates, in cross-section, another exemplary, non-limiting embodiment of a power driver including a chuck cone containing a plurality of movable chuck jaws 602 for selectively holding and releasing an accessory (e.g., a drill bit). The tool chuck cone is mounted on a input shaft 650 that may, as disclosed in the '1056 application, incorporate additional mechanisms (not shown) for actuating the chuck jaws 602. As illustrated in FIG. 9, the chuck cone can include an outer chuck cover 651 that includes a threaded lower internal surface. The threaded surface of the chuck cover 651 can engage a corresponding threaded exterior surface of the gear case housing 676. As illustrated in FIG. 9, the chuck cover 651 can also include an interior flange that may seat against an upper surface of the gear case housing 676 and form a bearing retention structure extending inwardly from the gear case housing.

The input shaft 650 is supported, in part, by an outer bearing 666 and an inner or needle bearing 674. The input shaft 650 is also connected to a hammer mechanism that includes a rotating ratchet 668, a fixed ratchet 670 and a cam ring 672 that is attached to or includes a user operable lever or sleeve for selectively engaging the ratchets, typically by rotating or sliding an external extension of the cam ring. As illustrated in FIG. 9, a spring 662, typically a compression spring, can be provided between a lower surface of the outer bearing 666 and the rotating ratchet 668. The rotating ratchet 668, fixed ratchet 670, spring 662 and majority of the cam ring 672 may be surrounded and contained within a backup sleeve arranged between the hammer mechanism and the gear case housing 676.

When the hammer mechanism is engaged, opposing faces of the rotating ratchet 668 and the fixed ratchet 670 will come into contact and, as the input shaft 650 rotates, will produce a ratcheting action that will displace the input shaft relative to the main body 680 to produce a reciprocating axial motion. This axial motion will be opposed by one or more springs 662 that engage the input shaft 650, or a projection from the input shaft directly or indirectly, and will tend to return the shaft to its non-displaced position.

Example embodiments of the invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the invention as set forth herein.

We claim:

1. A power driver comprising:

a power driver housing;

an input shaft supporting chuck jaws and mounted for rotation relative to the power driver housing;

an inner bearing assembly providing rotational support for the input shaft;

an outer bearing assembly providing rotational support for the input shaft;

a hammer assembly arranged between the inner and the outer bearing assemblies to impart an axial displacement of the input shaft between an initial position and a displaced position relative to the power driver housing during rotation of the input shaft;

a biasing assembly tending to move the input shaft in an axial direction; and a bearing retainer fixed to the power driver housing, the bearing retainer having a rearward facing surface perpendicular to the axial direction for engaging an outer face of the outer bearing assembly to limit an outward axial movement of the outer bearing assembly relative to the power driver housing.

2. The power driver according to claim 1, wherein:

the biasing assembly engages an inner circumferential portion of the outer face of the outer bearing assembly; and the bearing retainer engages an outer circumferential portion of the outer face of the outer bearing assembly, wherein the biasing assembly and the bearing retainer cooperate to limit the outward axial movement of the outer bearing assembly.

3. The power driver according to claim 2, wherein:

the power driver housing defines an inner circumferential surface that limits an inward axial movement of the outer bearing assembly and cooperates with the biasing assembly and the bearing retainer to limit the axial movement of the outer bearing assembly.

4. The power driver according to claim 1, wherein:

the power driver housing defines an inner circumferential surface that limits an inward axial movement of the outer bearing assembly.

5. The power driver according to claim 1, wherein:

the hammer assembly includes a first anvil rotationally fixed to the input shaft, a second anvil rotationally fixed to the power driver housing and a mode selector mechanism to engage the first and second anvils.

6. The power driver according to claim 5, wherein:

the biasing assembly engages a circumferential portion of an inner face of the outer bearing assembly; and the biasing assembly engages a circumferential portion of the first anvil.

7. The power driver according to claim 6, wherein:

the input shaft engages an inner circumferential portion of the outer face of the outer bearing assembly; and the bearing retainer engages an outer circumferential portion of the outer face of the outer bearing assembly, wherein the input shaft and the bearing retainer cooperate to limit the outward axial movement of the outer bearing assembly.

8. A power driver comprising:

a power driver housing;

an input shaft supporting chuck jaws and mounted for rotation relative to the power driver housing;

an inner bearing assembly providing rotational support for the input shaft;

an outer bearing assembly providing rotational support for the input shaft;

a hammer assembly arranged between the inner and the outer bearing assemblies to impart an axial displacement of the input shaft between an initial position and a displaced position relative to the power driver housing during rotation of the input shaft;

a biasing assembly tending to return the input shaft to the initial position;

a bearing retainer fixed to the power driver housing to limit an outward axial movement of the outer bearing assembly relative to the power driver housing; and a sleeve extending between the hammer assembly and the bearing retainer, the sleeve defining a top surface to engage a circumferential portion of an inner face of the outer bearing assembly, whereby the input shaft, the bearing retainer and the sleeve cooperate to limit axial movement of the outer bearing assembly, wherein the biasing assembly engages the circumferential portion of the inner face of the outer bearing assembly; and the biasing assembly engages a circumferential portion of a first anvil of the hammer assembly, wherein the input shaft engages an inner circumferential portion of the outer face of the outer bearing assembly, and wherein the bearing retainer engages an outer circumferential portion of an outer face of the outer bearing assembly, wherein the input shaft and the bearing retainer cooperate to limit the outward axial movement of the outer bearing assembly.

9. A power driver comprising:

a power driver housing;

an input shaft supporting chuck jaws and mounted for rotation relative to the power driver housing;

an outer bearing assembly and an inner bearing assembly providing rotational support for the input shaft;

a bearing retainer fixed to the power driver housing, the bearing retainer having a rearward facing surface for engaging an outer face of the outer bearing assembly to limit an outward axial movement of the outer bearing assembly relative to the power driver housing;

a hammer assembly positioned rearward of the outer bearing assembly to impart an axial displacement of the input shaft between an initial position and a displaced position relative to the power driver housing during rotation of the input shaft; and a biasing assembly tending to urge the input shaft in an axial direction, wherein the hammer assembly includes a first anvil rotationally fixed to the input shaft, a second anvil rotationally fixed to the power driver housing and a mode selector mechanism to engage the first and second anvils, wherein the inner bearing assembly is positioned rearward of the first anvil.

10. The power driver according to claim 9, wherein:

the bearing retainer is attached to the power driver housing at a point behind the inner bearing assembly.

11. A power driver comprising:

a power driver housing;

an input shaft supporting chuck jaws and mounted for rotation relative to the power driver housing;

an outer bearing assembly and an inner bearing assembly providing rotational support for the input shaft;

a bearing retainer fixed to the power driver housing, the bearing retainer having a rearward facing surface for engaging an outer face of the outer bearing assembly to limit an outward axial movement of the outer bearing assembly relative to the power driver housing;

a hammer assembly positioned rearward of the outer bearing assembly to impart an axial displacement of the input shaft between an initial position and a displaced position relative to the power driver housing during rotation of the input shaft; and a biasing assembly tending to urge the input shaft in an axial direction, wherein the bearing retainer extends below the hammer assembly and includes a slot to accommodate a radially projecting portion of the mode selector mechanism.

12. A power driver comprising:

a power driver housing;

an input shaft supporting chuck jaws and mounted for rotation relative to the power driver housing;

an outer bearing assembly and an inner bearing assembly providing rotational support for the input shaft; and a bearing retainer fixed to the power driver housing, the bearing retainer having a rearward facing surface for engaging an outer face of the outer bearing assembly to limit an outward axial movement of the outer bearing assembly relative to the power driver housing, wherein a forward portion of the power driver housing has a first surface configuration; and a rear portion of the bearing retainer has a second surface configuration, wherein the first surface configuration and the second surface configuration cooperate to form an interlocking attachment.

13. A power driver comprising:

a power driver housing;

an input shaft supporting chuck jaws and mounted for rotation relative to the power driver housing;

an outer bearing assembly and an inner bearing assembly providing rotational support for the input shaft; and a bearing retainer fixed to the power driver housing, the bearing retainer having a rearward facing surface for engaging an outer face of the outer bearing assembly to limit an outward axial movement of the outer bearing assembly relative to the power driver housing, wherein the bearing retainer is attached to the power driver housing at a point behind the outer bearing assembly.

14. A power driver comprising:

a power driver housing;

an input shaft supporting chuck jaws and mounted for rotation relative to the power driver housing;

an outer bearing assembly and an inner bearing assembly providing rotational support for the input shaft; and a bearing retainer fixed to the power driver housing, the bearing retainer having a rearward facing surface for engaging an outer face of the outer bearing assembly to limit an outward axial movement of the outer bearing assembly relative to the power driver housing;

a hammer assembly positioned rearward of the outer bearing assembly to impart an axial displacement of the input shaft between an initial position and a displaced position relative to the power driver housing during rotation of the input shaft; and a biasing assembly tending to urge the input shaft in an axial direction, wherein the bearing retainer is attached to the power driver housing at a point behind the hammer assembly.

15. A power driver comprising:

a power driver housing;

an input shaft supporting chuck jaws and mounted for rotation relative to the power driver housing;

an outer bearing assembly providing rotational support for the input shaft; and a bearing retainer to limit an outward axial movement of the outer bearing assembly relative to the power driver housing, a forward portion of the power driver housing has a first threaded surface; and a rear portion of the bearing retainer has a second threaded surface, wherein the first threaded surface and the second threaded surface cooperate to form an interlocking attachment.

16. A power driver comprising:

a power driver housing;

a input shaft supporting chuck jaws and mounted for rotation relative to the power driver housing;

an outer bearing assembly and an inner bearing assembly providing rotational support for the input shaft; and a bearing retainer having a rearward facing surface for engaging an outer face of the outer bearing assembly to limit an outward axial movement of the outer bearing assembly relative to the power driver housing, wherein a forward portion of the power driver housing has a protruding region; and a rear portion of the bearing retainer has a concave surface structure, wherein the protruding region is pressed into the concave surface structure in an axial direction to form an interlocking attachment.

17. A power driver comprising:

a power driver housing;

an input shaft supporting chuck jaws and mounted for rotation relative to the power driver housing;

an inner bearing assembly providing rotational support for the input shaft;

an outer bearing assembly providing rotational support for the input shaft;

a hammer assembly arranged between the inner and the outer bearing assemblies to impart an axial displacement of the input shaft relative to the power driver housing during rotation of the input shaft;

a biasing assembly arranged between the outer bearing assembly and the inner bearing assembly that urges the input shaft rearwardly in an axial direction; and a bearing retainer fixed to the power driver housing to limit an outward axial movement of the outer bearing assembly relative to the power driver housing.

* * * * *